US008448350B2

(12) United States Patent
Nataadiningrat et al.

(10) Patent No.: US 8,448,350 B2
(45) **Date of Patent: *May 28, 2013**

(54) PROTECTIVE FOOT COVERING AND DANCE SHOES INCORPORATING SAME

(75) Inventors: Melissa Nataadiningrat, Oakland, NJ (US); Laura M. Jacobs, New York, NY (US)

(73) Assignee: Ballet Makers, Inc., Totowa, NJ (US)

( * ) Notice: Subject to any disclaimer, the term of this patent is extended or adjusted under 35 U.S.C. 154(b) by 574 days.

This patent is subject to a terminal disclaimer.

(21) Appl. No.: 12/706,179

(22) Filed: Feb. 16, 2010

(65) Prior Publication Data

US 2010/0154251 A1 Jun. 24, 2010

Related U.S. Application Data

(63) Continuation-in-part of application No. 11/228,178, filed on Sep. 16, 2005, now Pat. No. 7,673,396.

(60) Provisional application No. 60/657,468, filed on Mar. 1, 2005.

(51) Int. Cl.
*A43B 5/12* (2006.01)

(52) U.S. Cl.
USPC ..... 36/8.3; 36/9 R

(58) Field of Classification Search
USPC ..... 36/8.3, 9 R, 11.5; 2/239–241
See application file for complete search history.

(56) References Cited

U.S. PATENT DOCUMENTS 2,237,652 A 4/1941 Capezio
2,391,064 A * 12/1945 McCandless ..... 2/239
2,771,691 A * 11/1956 Luchs ..... 36/10
2,954,617 A * 10/1960 Yamaguchi ..... 36/11.5
3,084,695 A * 4/1963 O'Donnell ..... 36/174
4,069,515 A * 1/1978 Swallow et al. ..... 2/239
4,199,878 A 4/1980 Wossner
4,277,897 A * 7/1981 O'Connell ..... 36/106
4,519,148 A 5/1985 Sisco
4,554,749 A 11/1985 Ostrander
4,651,354 A * 3/1987 Petrey ..... 2/239
5,054,129 A * 10/1991 Baehr ..... 2/409
5,092,347 A * 3/1992 Shaffer et al. ..... 128/892
5,220,735 A 6/1993 Raoul-Duval
5,682,685 A 11/1997 Terlizzi
5,867,838 A * 2/1999 Corry ..... 2/239
6,018,888 A 2/2000 Wilkenfeld et al.
6,076,284 A 6/2000 Terlizzi
6,588,124 B2 7/2003 Morrone (Continued)

*Primary Examiner* — Marie Patterson

(74) *Attorney, Agent, or Firm* — Laubscher & Laubscher, P.C.

(57) ABSTRACT

A protective foot cover for use in dance, exercise, or athletic applications using strategically placed thicker protective pieces in ball and toe areas of the foot in connection with an elastic material in the sole structure to allow the foot to move freely and provide less of a barrier between the foot and floor such that a dancer can better sense the floor upon which they dance. The foot cover incorporates strategically placed protective patches that provide support, protection, and comfort to the ball and toe portions of the foot. The patches are spaced from one another so that the footwear is able to move more naturally with the expansion of the foot as pressure is applied to the foot. The foot cover may be used alone, whereby the toe and heel portions of the foot are exposed, or in combination with a dance shoe providing a stretchable sole running from the arch portion to the toe portion of the foot.

13 Claims, 10 Drawing Sheets

U.S. PATENT DOCUMENTS

| | | | | |
|---|---|---|---|---|
| 6,705,026 | B1 | 3/2004 | Arbour | |
| 7,051,457 | B1 * | 5/2006 | Huggins et al. | 36/4 |
| 7,673,396 | B2 * | 3/2010 | Terlizzi et al. | 36/8.3 |
| 7,856,739 | B2 * | 12/2010 | Terlizzi et al. | 36/8.3 |
| 2003/0029055 | A1 | 2/2003 | Morrone | |
| 2004/0261289 | A1 * | 12/2004 | Lindsay | 36/7.5 |
| 2006/0107444 | A1 * | 5/2006 | Huggins | 2/239 |
| 2006/0179549 | A1 * | 8/2006 | Huggins et al. | 2/239 |
| 2006/0288609 | A1 * | 12/2006 | Wilkenfeld et al. | 36/8.3 |
| 2007/0006486 | A1 * | 1/2007 | Wilkenfeld et al. | 36/8.3 |

* cited by examiner 136
140
126
122
100
106
108
124
134
132A
132B
102
13B

PROTECTIVE FOOT COVERING AND DANCE SHOES INCORPORATING SAME

CROSS-REFERENCE TO RELATED APPLICATIONS

The present application is a continuation-in-part of U.S. application Ser. No. 11/228,178 filed Sep. 16, 2005 now U.S. Pat. No. 7,673,396 which claims benefit of U.S. Provisional Application Ser. No. 60/657,468, filed Mar. 1, 2005, the disclosures of which are hereby incorporated by reference herein.

BACKGROUND OF THE INVENTION

The present invention relates generally to footwear, and more particularly to footwear used for dancing.

Every culture around the world includes some form of dancing. In less advanced cultures, the dance movements may be very simple. In more advanced cultures, the form of dance may be very developed and complex, such as ballet. Regardless of the type of dance, however, all dance movements involve the use of the feet. When an individual dances, the feet are stomped, flexed and pointed, and used to jump, leap, bend, spine, turn, etc. Further, dance movements are executed on various types of floor materials. Some of these floor materials may be abrasive or tacky, which could cause foot injuries.

When dancing, the feet are often protected using shoes and foot coverings having padding on the sole portions thereof. Traditional dance shoes have a continuous sole running the length of the bottom of the shoe. Examples of continuous sole dance shoes include U.S. Pat. Nos. 4,199,878, 5,220,735, and 6,705,026. While continuous sole dance shoes effectively protect the feet from direct exposure to a floor, such shoes have limited flexibility. The lack of flexibility makes it more difficult for a dancer to move his or her feet into the various foot positions.

Recently, designers have incorporated a split sole structure into dance shoes. In the split sole design, a first sole underlies the toe and ball section of the foot and a second sole, spaced from the first sole, underlies the heel section of the foot. The arch section of the foot is not supported by either the first or the second sole, but is supported by a flexible material that extends between the first and the second soles. Split sole shoe designs are disclosed in U.S. Pat. Nos. 4,519,148 and 4,554,749, which teach a shoe or slipper that is usable in a dance application, and U.S. Pat. Nos. 6,076,284 and 5,682,685, which teach ballet pointe shoes having a flexible band, wrapped around the arch section of the foot. U.S. Pat. No. 6,588,124 and U.S. Patent Appln. No. 2003/0029055 illustrate a dance shoe having a diamond shaped "gusset" region covering the arch of the foot. While the above-described shoes provide enhanced flexibility during foot movement, there remains a problem with material bunching beneath the arch of the foot. Moreover, the above-described shoes do not allow the dancer to maintain a tactile awareness of the floor surface, because the material underlying the foot creates a barrier between the foot and the floor.

Another form of dance, commonly referred to as modern dance, is performed barefoot. Although modern dance is based upon movements found in classical ballet, the dramatic movements, completed barefoot, may cause serious foot injuries. In response to the need for some form of foot protection, a few designs have been created, including U.S. Pat. Nos. 2,237,652 and 6,018,888, both of which incorporate an open toe structure having a strap running between the large toe and next toe, and a heel strap. Unfortunately, both of these designs completely cover the ball section of the foot, restricting a dancer's tactile sense of the floor. Additionally, the heel strap found in both designs may press into the heel, causing discomfort.

A product disclosed by U.S. Pat. No. 7,051,457 and sold under the trademark DANCE PAWS, by Dance Paws LLC of Cambridge, Mass., provides a form-fitting, toe-less sock that covers the forward half of a foot.

Referring to FIG. 1, the form-fitting sock 20 is made of spandex and has an elastic band 22 that holds the sock 20 over a forward half of the foot. The sock 20 has a leading end 24 with five openings 26A-26E one for each toe. The sock 20 also has a trailing end 28 with a large opening for inserting the foot. The underside of the sock 20 has a single suede patch 30 attached thereto. The suede patch 30 covers the ball portion of the foot, and extends from the leading end 24 toward the trailing end 28 and between an inside 32 and an outside 34 thereof. When the sock 20 is pulled over the foot, the single suede patch 30 generally covers the ball of the foot, extending from the inside of the foot to the outside of the foot. The suede patch 30 is not elastic. As a result, the sock cannot expand and stretch in the ball region thereof for accommodating expansion and stretching of the foot during various dance maneuvers.

Thus, there is a need for a dance shoe or foot covering that will protect and cushion the foot. There is also a need for a dance shoe or foot covering that will not restrict or constrain the foot as the foot moves through various positions. There is also a need for a dance shoe or foot covering that enables a dancer to adequately sense the floor with the bottom of the foot. In addition, there is a need for a dance shoe or foot covering that enables the ball of the foot to stretch and expand as necessary, as well as a dance shoe or foot covering that provides more traction in certain areas and less traction in other areas.

SUMMARY OF THE INVENTION

It is an object of the present invention to provide a foot covering or dance shoe that protects the foot from injury, allows freedom of foot movement without gapping, sagging, buckling or puckering of material, and allows the foot to sense the floor beneath it.

It is a further object of the invention to increase the comfort of the foot covering on the wearer's foot.

It is another object of the present invention to provide a flexible protective foot covering that easily adjusts to the size and movement of dancers' feet.

It is yet another object of the present invention to provide a foot covering or dance shoe that has a stretchable and/or elastic underside, which allows natural foot movement and expansion to occur when weight and pressure are put on the foot, without causing pressure or restriction to the foot by the foot covering.

In one preferred embodiment of the present invention, a foot covering includes an elastic fabric having a leading end and a trailing end having a foot opening, and first and second protective pads attached to the elastic fabric, the first and second protective pads having opposing edges. The elastic fabric desirably extends at least partially between the opposing edges of the first and second protective pads, whereby the elastic fabric is adapted to stretch between the opposing edges of the first and second protective pads. When the foot covering is pulled onto a foot, the first and second protective pads are adapted to cover a ball of a foot. The elastic fabric desirably has at least one toe opening at the leading end of the fabric. The at least one toe opening may include a first toe opening for a big toe of a foot and a second toe opening for one or more remaining toes of the foot. The foot covering may include an elastic band attached to the trailing end of the elastic fabric for holding the foot covering on a foot.

In certain preferred embodiments, the foot covering may include a fabric strip extending between the opposing edges of the first and second protective pads. The fabric strip may have a first end attached to the first protective pad and a second end attached to the second protective pad. At least one of the protective pads may have a first region and a second region having a tackier surface than the first region. The first region may be made of leather or suede and the second region may include rubber.

The elastic fabric may be made of lycra, lycra mesh, cotton lycra mesh, paper lycra, leather, leather with lycra, nylon, nylon mesh, neoprene or any elastic mesh material. In another preferred embodiment of the present invention, a foot covering includes a fabric having a leading end and a trailing end, the fabric having at least one toe opening at the leading end of the fabric and a foot opening at the trailing end of the fabric. The foot covering desirably includes at least one protective pad attached to the fabric, the at least one protective pad having a first region and a second region having a tackier surface than the first region. The at least one protective pad may include first and second protective pads attached to the fabric, the fabric including an elastic fabric extending at least partially between opposing edges of the first and second protective pads. The elastic fabric is adapted to stretch between the opposing edges of the first and second protective pads. The first and second protective pads are adapted to cover a ball of a foot when the foot covering is secured to the foot.

The foot covering may include an elastic band attached to the trailing end of the fabric for holding the foot covering on a foot.

In another preferred embodiment of the present invention, a dance shoe includes a shoe upper, a sole attached to the shoe upper, the sole including a ball region extending between an arch of the dance shoe and a toe of the dance shoe. The ball region of the sole desirably includes an elastic fabric and at least two protective pads attached to the elastic fabric, whereby the elastic fabric extends at least partially between opposing edges of the at least two protective pads so that the ball region of the sole is stretchable and expandable between the at least two protective pads.

The ball region of the sole is preferably adapted to cover a ball of a foot and the at least two protective pads are adapted to protect the ball of the foot. The at least two protective pads may include first and second protective pads adapted to cover a ball of a foot and a third protective pad adapted to cover a toe of the foot. The dance shoe may include a fourth protective pad adapted to cover a second toe of the foot. A fabric strip may extend between the opposing edges of the at least two protective pads.

At least one of the protective pads has a first region and a second region having a tackier surface than the first region. The first region may include a material selected from the group consisting of leather and suede and the second region may include rubber. The elastic fabric may be made of lycra, lycra mesh, cotton lycra mesh, paper lycra, leather, leather with lycra, nylon, nylon mesh, neoprene or any elastic mesh material.

In still another preferred embodiment of the present invention, a dance shoe includes a shoe upper, and a sole attached to the shoe upper, the sole including a ball region extending between an arch of the dance shoe and a toe of the dance shoe. The ball region of the sole desirably includes a fabric and at least two protective pads attached to the fabric, whereby at least one of the protective pads has a first region and a second region having a tackier surface than the first region. The fabric may be an elastic fabric adapted to stretch and flex, the elastic fabric extending at least partially between opposing edges of the at least two protective pads so that the ball region of the sole is stretchable and expandable between the at least two protective pads.

According to the invention, the footwear may be in the form of a foot covering, a dance shoe, a dance sandal, a dance sneaker, a dance slipper, a gymnastic shoe, an exercise shoe, an athletic shoe or sneaker, etc. It may be used in such activities as dance, yoga, swimming, tai chi, stretching, gymnastics, Pilates, aerobics, recreational body movement, acrobatics and martial arts.

These and other preferred embodiments of the present invention will be described in more detail below.

BRIEF DESCRIPTION OF THE DRAWINGS

The above description, as well as further objects, features and advantages of the present invention will be more fully understood with reference to the following description of preferred embodiments considered in conjunction with the accompanying drawings.

DETAILED DESCRIPTION OF PREFERRED EMBODIMENTS

Figure 1:
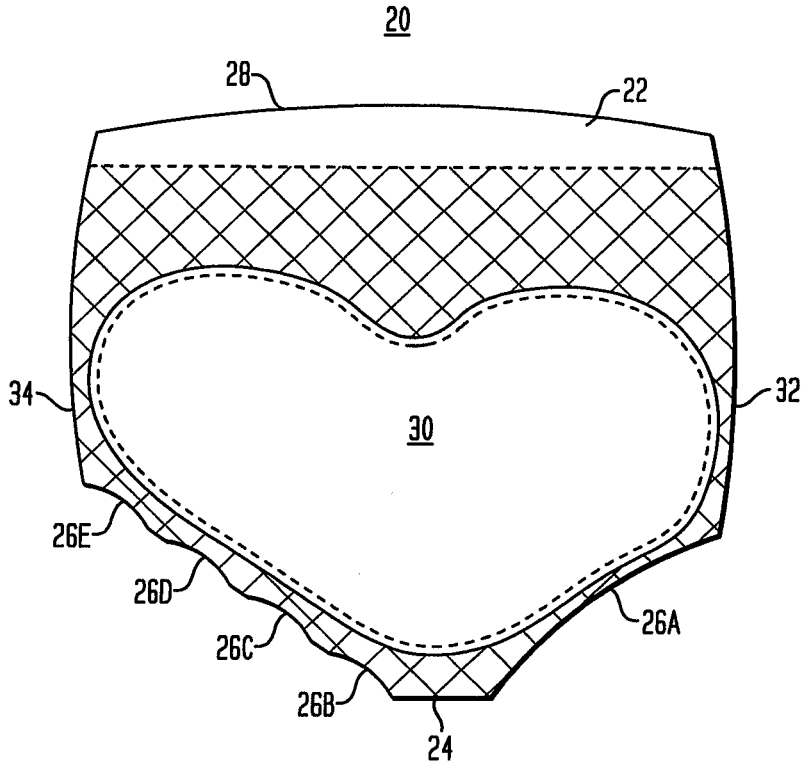
FIG. 1 (PRIOR ART)
FIG. 1 shows a bottom view of a prior art foot covering.
Figure 2B:
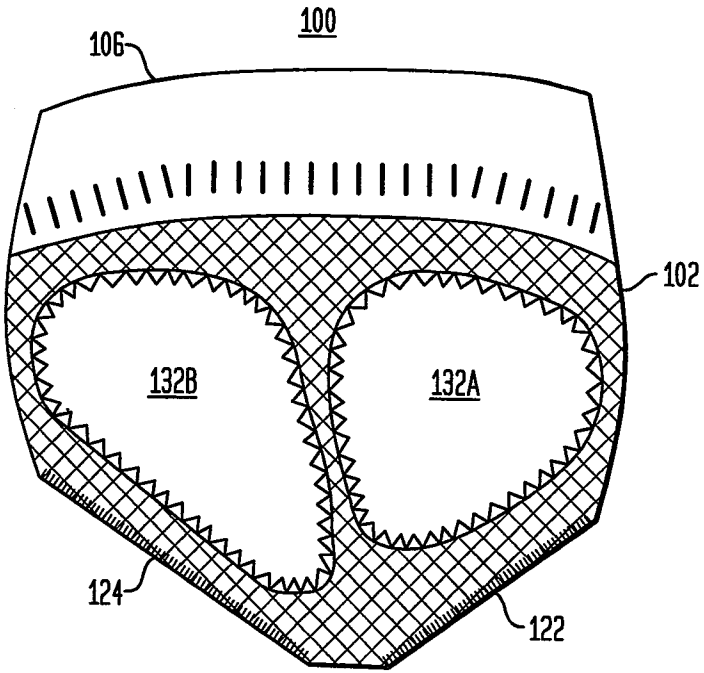
FIG. 2B is a bottom view of the foot covering shown in FIG. 2A.
Figure 2A:
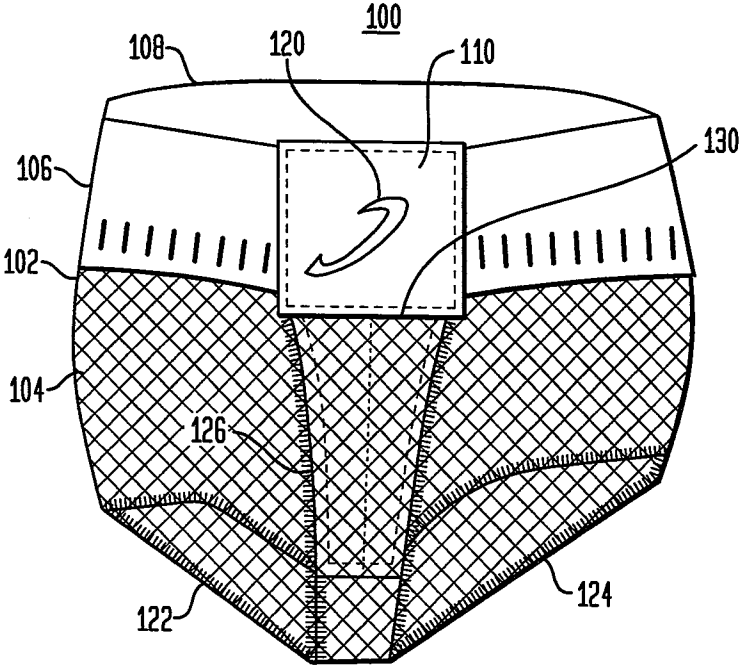
FIG. 2A is a top view of a foot covering, in accordance with one preferred embodiment of the present invention.

Referring to FIGS. 2A and 2B, in certain preferred embodiments of the present invention, a foot covering 100 includes a fabric 102 that is adapted to cover a foot. In certain preferred embodiments, the fabric is elastic, flexible, stretchable and/or breathable. In other preferred embodiments, the fabric is a mesh material having a plurality of pores 104 formed therein. The mesh material is preferably an elastic, breathable fabric. The pores 104 preferably enhance the tactile sense of a dancer when the foot covering 100 is worn over the front half of a foot. In certain preferred embodiments, the fabric 102 may be made of nylon, cotton, Lycra, and/or neoprene.

The foot covering 100 preferably includes an elastic band 106 attached to an edge of the mesh fabric 102. The elastic band defines a foot opening 108 (FIG. 2A) through which toes and the ball of a foot may be inserted. As will be described in more detail below, after the foot covering 100 has been secured over the ball portion of a foot, the elastic band 106 preferably maintains the foot covering in place.

The foot covering 100 also desirably includes a label 110 that may be sewn onto the band 106. The label 110 may include a logo or emblem 120 printed thereon. Other information may be placed on the label such as size information, a patent number, sku information, etc.

The foot covering 100 also preferably includes a first toe opening 122 adapted to receive a large toe on a foot and a second toe opening 124 adapted to receive the remaining four toes on a foot. In certain preferred embodiments, the second toe opening 124 is larger than the first toe opening 122. The first and second toe openings 122, 124 may be generally circular or ovoid in shape, however, no particular shape is necessary for providing an adequately functioning toe opening.

The foot covering 100 also preferably includes a strap 126 that extends between and divides the first toe opening 122 from the second toe opening 124. In certain preferred embodiments, the strap 124 overlaps with another section of the fabric 102 to provide a reinforced region 128 having enhanced strength or ruggedness. The strap 126 preferably has an upper end 130 that is connected with the elastic band 106 or the label 110. In certain preferred embodiments, the upper end 130 of the strap 126 is sewn to either the elastic band 106 or the label 110 or both.

Referring to FIG. 2B, in certain preferred embodiments of the present invention, an underside of the foot covering 100 preferably includes one or more protective pads 132A, 132B. The protective pads are preferably made of a material that is more rugged than the mesh fabric 102. The protective pads 132A, 132B are designed to protect the ball of the foot. The protective pads 132A, 132B are spaced from one another so that the elastic material between the pads can flex and stretch to accommodate changes to the foot as the foot moves through various positions. In highly preferred embodiments, the protective pads may be made of leather, suede, rubber or cotton fabric.

In the particular embodiment shown in FIG. 2B, the first protective pad 132A is in registration with the first toe opening 122 that is adapted to receive the large toe of a foot. The second protective pad 132B is in registration with the second toe opening 124 adapted to receive the remaining toes of a foot. The protective pads are preferably positioned relative to the toe openings so that they protect the ball portions of the foot associated with the toes. For example, the first protective pad is positioned relative to the first toe opening so that it covers the ball portion of the foot associated with the large toe. The exact distances between the toe openings and the protective pads may vary depending upon the size and shape of a foot. The exact geometric shape of the protective pads 132A, 132B may vary in response to varies factors such as the size of a foot of the particular activity to which to the foot covering will be put.

In the particular preferred embodiment shown in FIG. 2B, the first protective pad 132A and the second protective pad 132B are adapted to cover the ball portion of the foot when the foot covering is worn on a foot. The first protective pad 132A is preferably rounder than the second protective pad 132B. The first protective pad 132A is preferably adapted to protect the ball portion of the foot associated with the large toe, while the second protective pad 132B is preferably adapted to protect the ball portion of the foot associated with the remaining four toes on a foot.

As noted above, at least a portion of the first pad 132A is spaced from at least a portion of the second pad 132B, so that the elastic fabric extends at least partially between the pads. As a result, the pads are able to move away from one another to accommodate expansion, widening and/or lengthening of the foot as the foot moves into various positions. Thus, the footwear is capable of expanding as the foot expands, without pinching or restraining natural foot movement.

Figures 3A, 3B, 3C:
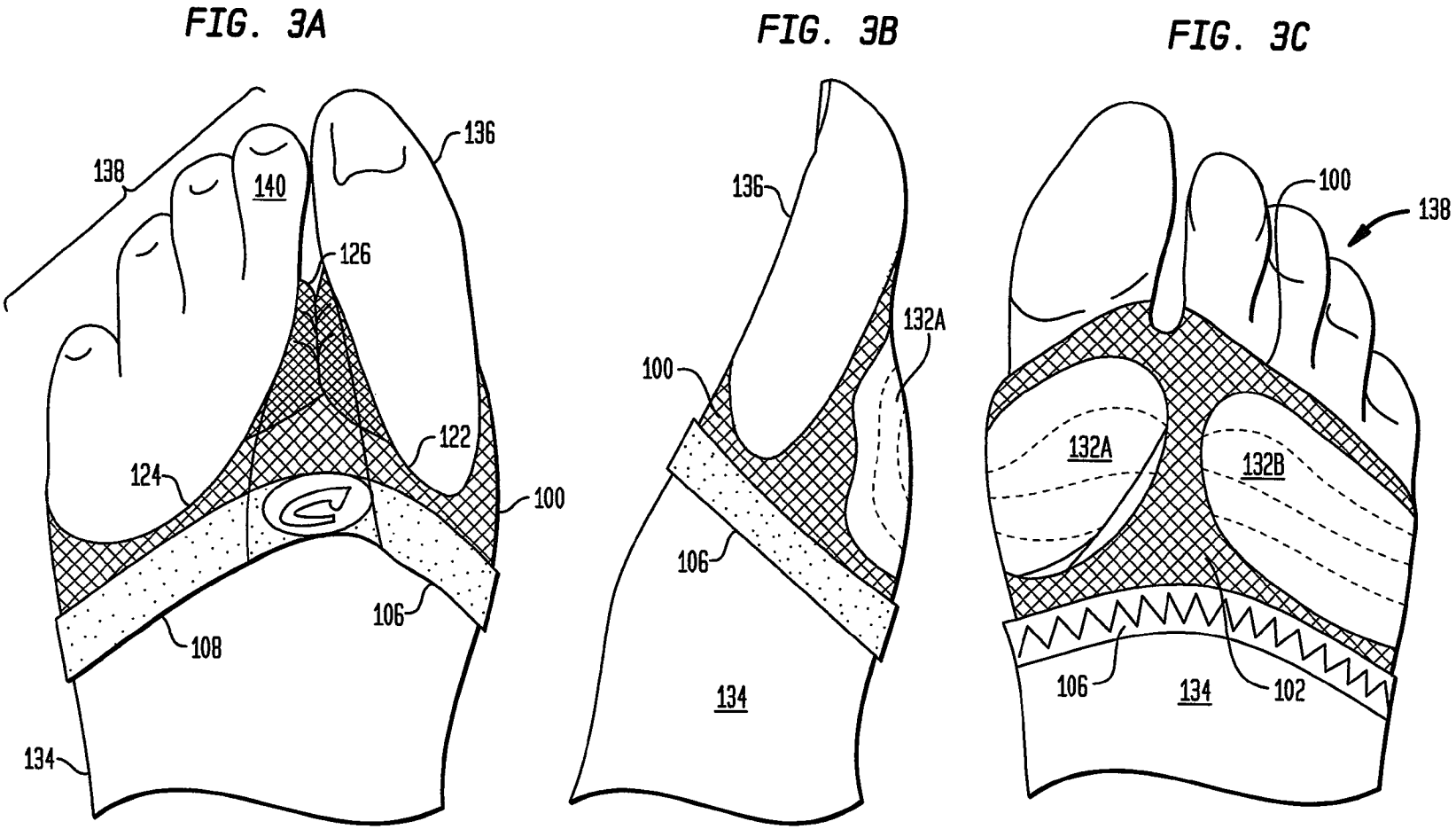
FIG. 3A is a top view of the foot covering shown in FIG. 2A, after the covering has been placed on a foot.
FIG. 3B is a side view of the foot covering shown in FIG. 3A.
FIG. 3C is a bottom view of the foot covering shown in FIG. 3A.

FIGS. 3A-3C the foot covering 100 of FIGS. 2A-2B with a foot 134 inserted into the foot covering. When placing the foot covering 100 onto the end of the foot 134, the elastic band 106 may be slightly stretched to enlarge the size of the foot opening 108. All of the toes of the foot 134 and then inserted into the foot opening 108. The large toe 136 is inserted into the first toe opening 122 and the remaining four toes 138 are inserted into the second toe opening 124. The strap 126 preferably extends between the large toe 136 and the fourth toe 140 of the foot. After the foot covering 100 has been pulled onto the foot, the elastic band 108 preferably holds the foot covering in place on the foot.

Although the present invention is not limited by any particular theory of operation, it is believed that providing an elastic band that surrounds the foot just below the ball of the foot is a tremendous advance over prior art foot coverings that use ankle straps for holding the covering in place. Thus, the present invention provides less restrained movement of a foot during various dance maneuvers. In addition, the present invention provides a foot covering or dance shoe having an outsole made of an elastic material, with two or more patches secured over the elastic material, the patches being spaced from one another for allowing stretching movement between the patches. The spaced patches on the bottom of the foot covering or dance shoe allows for stretching/expansion of the fabric between the patches and natural movement of the foot as it expands and contracts.

Referring to FIG. 3A, in certain preferred embodiments, the foot covering 100 may include one or more straps having fasteners, buttons, Velcro or other securing means. The straps (not shown) may be incorporated with the band 106 for adjusting the size of the foot opening 108. In other preferred embodiments, the straps may be used to adjust the fit of the foot covering 100 around the ball of the foot 134. In more preferred embodiments, the band 106 is an elastic, closed loop that can be stretched for fitting over the ball of the foot. After the foot covering 100 has been pulled over the foot, the elasticity of the band 106 holds the band firmly to the portion of the foot immediately behind the ball of the foot.

FIG. 3B shows the foot covering 100 secured over the ball of a foot. The elastic band 106 holds the foot covering snugly to the ball portion of the foot.

Referring to FIGS. 3B and 3C, after the foot covering 100 has been secured over the foot 134, the first protective pad 132A underlies the ball portion of the foot associated with the large toe 136, and the second protective pad 132B preferably underlies the ball portion of the foot 134 associated with the four smaller toes 138. The opposing edges of the pads 132A, 132B are spaced from one another and have the elastic material 102 extending therebetween so that the ball section of the foot covering can stretch to accommodate expansion of the foot.

Figure 4:
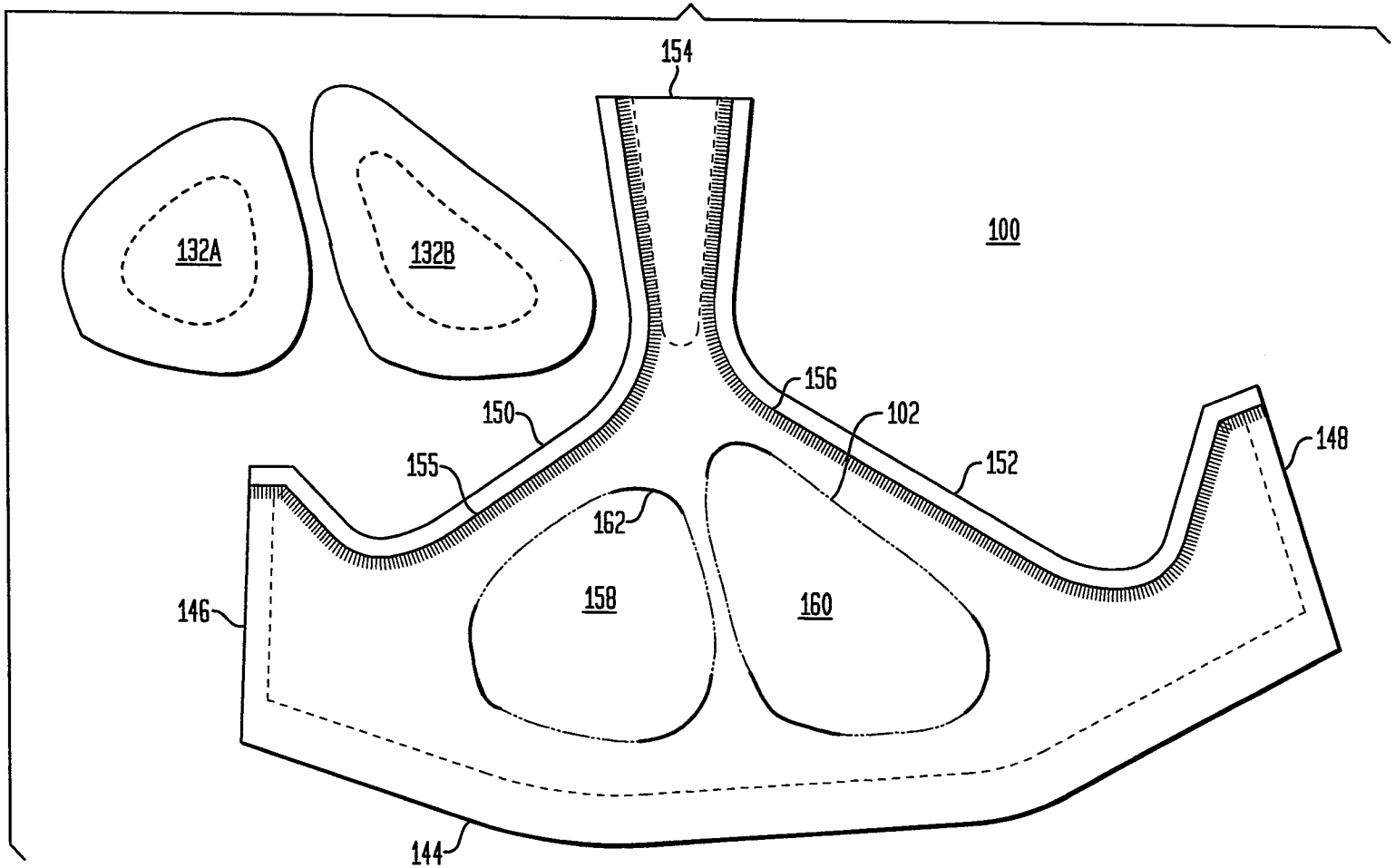
FIG. 4 shows the foot covering of FIGS. 2A and 2B prior to assembly.

FIG. 4 shows the various elements that may be used for assembling the foot covering shown in FIGS. 2A-2B. The foot covering 100 includes the elastic/stretchable fabric 102. The fabric is desirably cut into a particular pattern piece that may be assembled into an item having the general configuration shown in FIG. 2A. The fabric 102 includes an elongated edge 144 extending between a first lateral edge 146 and a second lateral edge 148. The fabric 102 also includes a first in-seam edge 150, a second in-seam edge 152 and an elongated neck 154 that will form the strap that extends between the large toe and the fourth toe. The pattern piece also includes a first surged edge 155 formed adjacent the first in-seam edge 150 and a second surged edge 156 formed adjacent the second in-seam edge 152. Before the fabric 102 is assembled together to form the foot covering shown in FIGS. 2*a* and 2B, the first and second in-seam edges 150, 152 are cut so that the surged edges 155, 156 form the new exterior edge of the fabric. The first surged edge 155 forms the first toe opening for the large toe of a foot and the second surged edge 156 forms the second toe opening for the four remaining toes on a foot (FIG. 3A).

Referring to FIG. 4, the pattern piece also includes a first region 158 adapted to receive the first protective pad 132A and a second region 160 adapted to receive the second protective pad 132B. The regions 158, 160 may have one or more alignment markers 162 formed thereon for facilitating placement and alignment of the protective pads 132A, 132B on the fabric. The pads may be attached to the fabric in a number of different ways including adhesion and stitching.

In order to assemble the foot covering 100, the lateral edges 146, 148 are brought together so that the edges are in substantial alignment with and opposed to one another.

The lateral edges 146, 148 may be attached to one another, such as by sewing or using an adhesive. However, any known means for connecting two edges of a fabric may be used. After the lateral edges 146, 148 have been brought together, the elongated edge 144 generally defines the foot opening shown in FIGS. 2A and 3A. The elongated neck 154 is then placed in general alignment with the elongated edge 144, with the lateral edges 146, 148 generally bisecting the neck 154. The neck 154 is preferably sewn or adhered to the fabric piece in the vicinity of the opposing lateral edges 146, 148. After the neck 154 and the lateral edges 146, 148 have been attached together, the foot covering has the general shape shown in FIGS. 2A and 2B. As noted above, the elongated neck 154 forms the strap of the foot covering and defines a first toe opening for the large toe and a second toe opening for the four remaining toes on a foot. The elastic band (not shown) may then be sewn to the elongated edge 144 of the pattern piece. The label with the logo (FIG. 2A) may then be sewn over the overlapping edges of the elastic band. The protective pads 132A, 132B may be attached to the respective regions 158, 160 of the fabric.

In certain preferred embodiments, the foot covering shown in FIGS. 2A-4 may be worn directly on a foot similar to underwear or a bodysuit. Thus, the foot covering may be worn alone. The foot covering may also be worn in layers, such as by first putting a sock over a foot and then putting the foot covering over the sock. In still other preferred embodiments, the foot covering can be worn inside footwear. For example, the foot covering may be placed onto the foot and then the foot may be placed into a sneaker or a dance shoe.

Figure 5A:
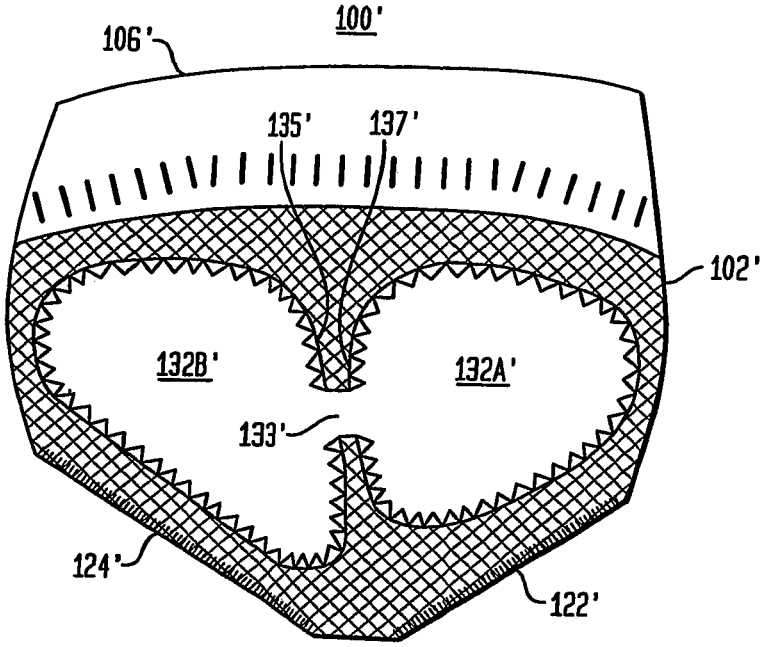
FIG. 5A shows a bottom view of a foot covering in accordance with another preferred embodiment of the present invention.
Figure 5B:
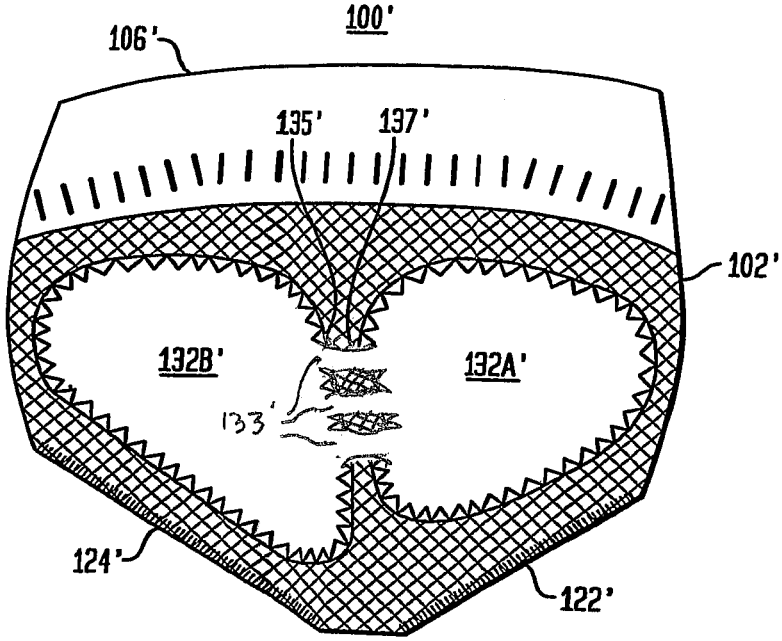
FIG. 5B shows a bottom view of a foot covering in accordance with a further embodiment of the present invention.
Figure 6:
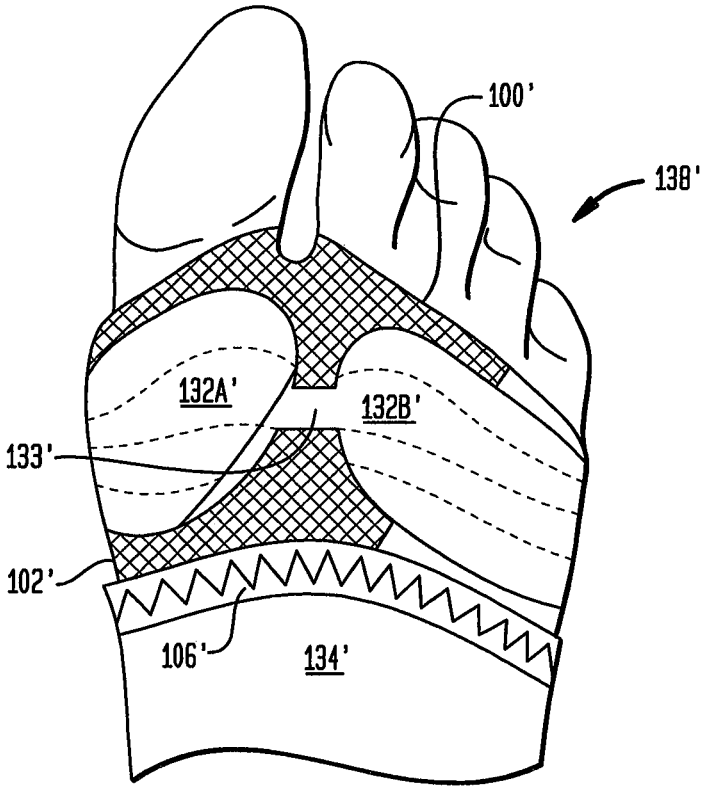
FIG. 6 shows the foot covering of FIG. 5 after the foot covering has been placed on a foot.

Referring to FIGS. 5A, 5B, and 6, in certain preferred embodiments of the present invention, a foot covering 100' is made of an elastic or stretchable fabric 102' and includes a first pad 132A' and a second pad 132B' that cover the ball portion of the foot. As shown in FIG. 5A, the foot covering 100' includes a fabric strip 133' that interconnects the first and second pads 132A', 132B'. The fabric strip 133' extends only partially between opposing edges 135', 137' of the respective first and second pads 132A', 132B'. As a result, the elastic fabric 102' extends between the pads so that the ball section of the foot covering can expand and stretch to accommodate expansion and stretching of the foot. The fabric strip may be integrally connected with the first and second pads, or may be attached to the first and second pads by adhesive or stitching. In the embodiment shown in FIG. 5B, a plurality of spaced strips 133*a'* extend between the pads.

Referring to FIG. 6, after the foot covering 100' has been pulled onto a foot 138', the first pad 132A' underlies the ball of the foot that is aligned with the big toe and the second pad 132B' is aligned with the ball of the foot that is aligned with the four smaller toes. The fabric strip 133' interconnects the first pad 132A' and the second pad 132B'. The flexible material 102' extends between the two pads 132A' and 132B' so that the ball section of the foot covering can expand in response to forces from the foot.

Figure 7:
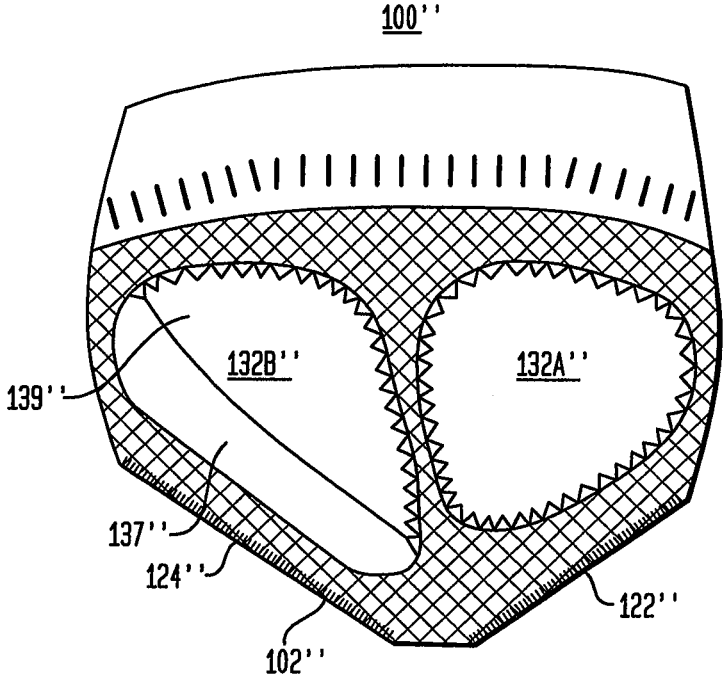
FIG. 7 shows a bottom view of a foot covering, in accordance with yet another preferred embodiment of the present invention.

Referring to FIG. 7, in another preferred embodiment of the present invention, a foot covering 100" includes an elastic material 102" that is able to stretch and expand in response to forces. The foot covering 100" includes a first protective pad 132A" that covers the ball of the foot and that is aligned with the first toe opening 122" and a second protective pad 132B" that covers the ball of the foot and that is aligned with the second toe opening 124" of the foot. The second pad 132B" includes a first region 137" that generates more traction with a floor surface and a second region 139" that generates less traction than the first region. In certain embodiments, the first region 137" may include a material such as rubber and the second region may include a material such as leather or suede. In certain preferred embodiments, the entire pad 132B" may be made of the same fabric and the first region 137" may be coated with a relatively tacky/sticky material. Although the present invention is not limited by any particular theory of operation, it is believed that providing pads having one or more tacky regions will enable a dancer to have better control when dancing on a floor surface. For example, when a dancer wants to slide over the floor surface, the dancer's weight can be positioned over the less tacky sections of the pads. When a dancer wants to come to a more abrupt stop, however, the dancer's weight can be positioned over the more tacky sections of the pads. In other preferred embodiments, each pad may have two or more tackier sections that are spaced from one another.

Figure 8A:
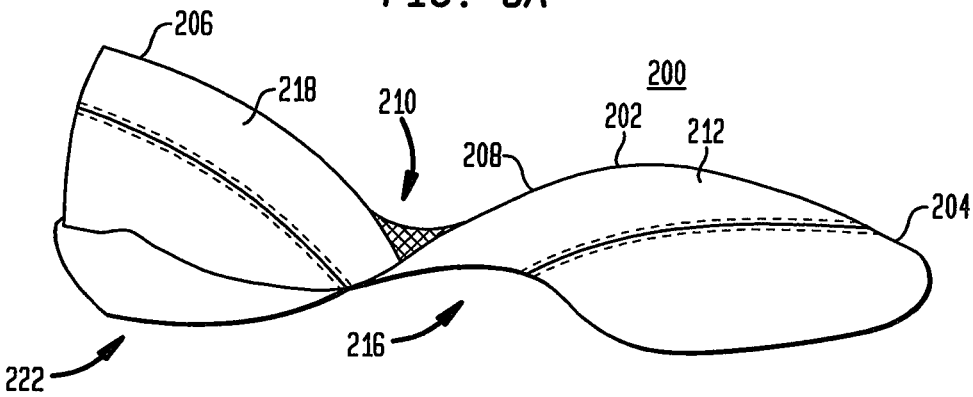
FIG. 8A is a side view of a dance shoe, in accordance with another preferred embodiment of the present invention.
Figure 8B:
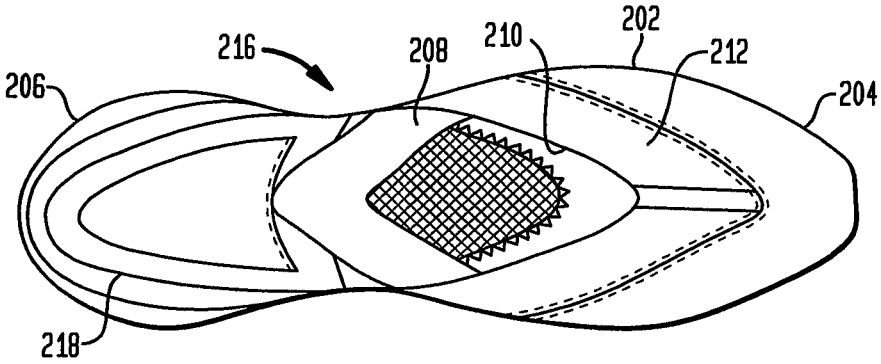
FIG. 8B is a top view of the dance shoe of FIG. 8A.
Figure 8C:
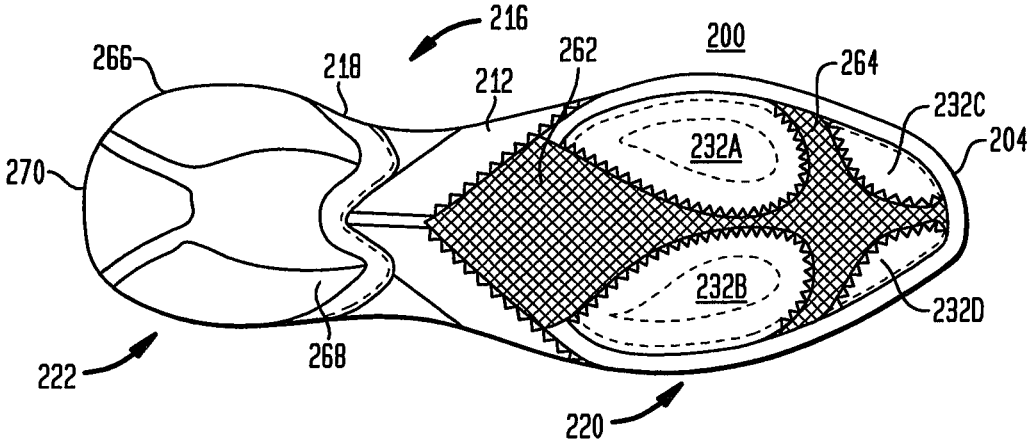
FIG. 8C is a bottom view of the dance shoe of FIG. 8A.

Referring to FIGS. 8A-8C, in another preferred embodiment of the present invention, a dance shoe incorporates portions of the foot covering shown in FIGS. 2A-7. Referring to FIG. 8A, a dance shoe 200 includes a shoe upper 202 having a toe region 204, a heel region 206 and a mid-section 208 that defines a shoe opening 210. The shoe upper may be made from any flexible fabric. Preferred fabrics for the shoe upper include leather, suede, rubber, neoprene, cotton Lycra, nylon Lycra, nylon, elastic, stretchable mesh, elastic gore, or other suitable stretchable materials. Referring to FIGS. 8A-8C, the shoe upper preferably includes a first elastic band that extends rearwardly from the toe region 204 of the shoe upper. The first elastic band extends from the toes toward the ball portion of the foot. The first elastic band 212 wraps around the arch portion of the arc region 216 of the shoe. The elastic band 212 preferably secures the dance shoe 200 over the front end of the foot after the toes and ball portion of the foot have been inserted into the shoe opening 210.

The dance shoe 200 also preferably includes a second elastic band 218 that generally covers the heel region 206 of the shoe upper. The second elastic band preferably extends from the heel region 206 to the arch region 216. The second elastic band 218 preferably holds the heel portion of the shoe around a user's ankle.

Referring to FIGS. 4A and 4C, the dance shoe 200 includes a sole having a first sole region 220 and a second sole region 222. The first sole region 220 desirably includes an elastic fabric that can stretch and then return to its original shape. The elastic fabric may be made of any material having elasticity such as leather with Lycra, Lycra, and paper Lycra. In certain preferred embodiments, the elastic material includes a mesh material 262 having a plurality of pores 264. Although the present invention is not limited by any particular theory of operation, it is believed that the porous mesh fabric provides a dancer with a tactile sense when the shoes are worn. In other words, a dancer is able to feel the floor or substrate through the pores 264 of the mesh fabric 262, which will undoubtedly improve control of the foot during various dance maneuvers.

In certain preferred embodiments, the mesh fabric is a flexible or elastic material. Preferably, the mesh fabric enables the foot to breathe through the fabric 262. In still other preferred embodiments, the mesh fabric is a nylon mesh, a cotton Lycra mesh, neoprene or any type of elastic mesh material. The particular size of the pores may vary. In preferred embodiments, the pores are sufficiently large to provide good tactile sense, while providing a reasonable level of support to the ball and arch of a foot.

Referring to FIG. 8C, one or more protective pads 232A-232D are secured to the mesh fabric 262. The pads may be secured to the interior surface of the fabric that abuts against the foot or the exterior surface of the fabric. The protective pads generally protect the underside of the foot as described above in the discussion of the foot covering shown in FIGS. 2A and 2B. In the particular preferred embodiment shown in FIG. 8C, the dance shoe 200 includes a first protective pad 232A and a second protective pad 232B that cover the ball portion on the underside of the foot. The dance shoe also includes a third protective pad 232C and a fourth protective pad 232D that cover the underside of the toe region 204 of the foot. The pads are separated from one another and are able to move away from one another due to the elasticity of the material between the two or more pads. The elastic material extending between the pads allows the ball section of the foot covering to expand and widen in response to expansion of the ball portion of the foot.

Referring to FIG. 8C, the second sole region 222 is covered by a sole 266 having a leading end 268 adjacent the arch 216 and a trailing end 270 at the heel of the dance shoe 200. The sole is preferably made of a material that is more rugged than the shoe upper material. In a particular preferred embodiment, the sole 266 is preferably made of material such as leather, suede, rubber, lightweight low-density foam material such as EVA polyethylene blend, a viso-elastic polymer such as SORBOTHANE, or other shock-absorbing materials.

Figure 9A:
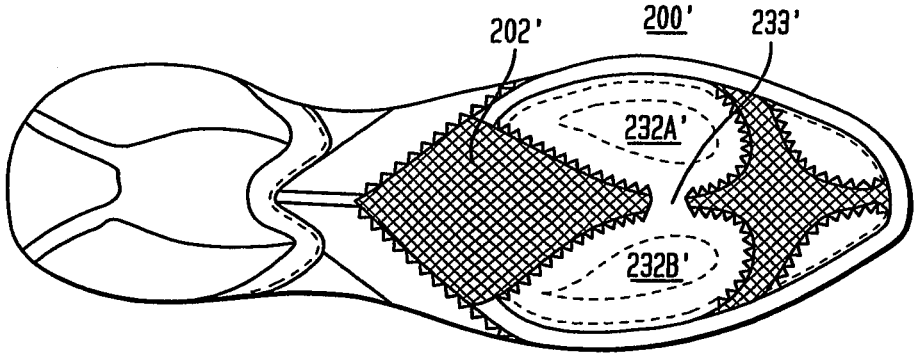
FIG. 9A is a bottom view of a dance shoe in accordance with another preferred embodiment of the present invention.
Figure 9B:
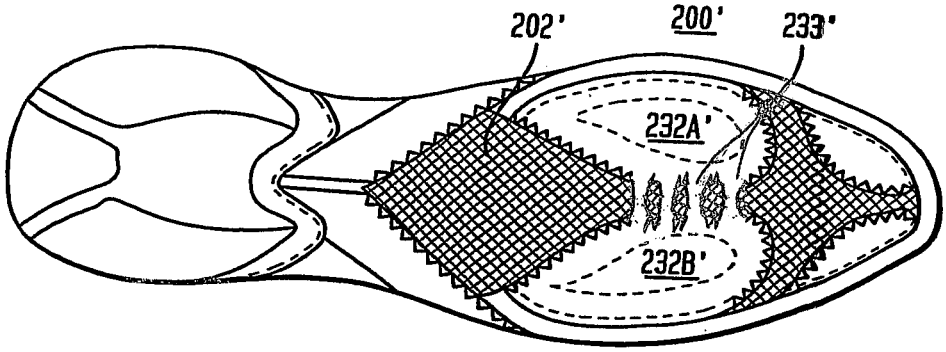
FIG. 9B is a bottom view of a dance shoe in accordance with a further embodiment of the present invention.

Referring to FIGS. 9A and 9B, in another preferred embodiment of the present invention, a dance shoe 200' is similar to the shoe shown in FIGS. 8A-8C. As shown in FIG. 9A, the shoe 200' includes a fabric strip 233' that connects the first and second pads 232A' and 232B'. The elastic material 202' extends between the two pads 232A' so that the ball section of the shoe can expand and stretch in response to forces from a foot. In the embodiment shown in FIG. 9B, a plurality of spaced fabric strips 233*a*' connect the first and second pads.

Figure 10A:
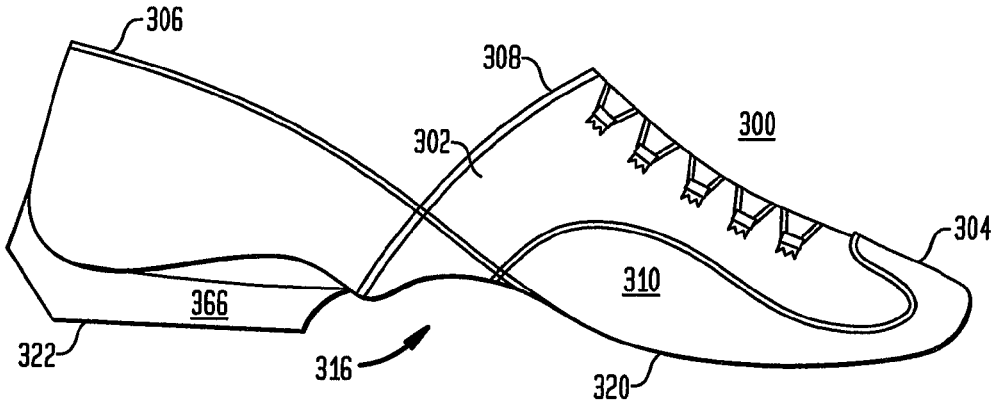
FIG. 10A is a side view of a dance shoe, in accordance with another preferred embodiment of the present invention.
Figure 10B:
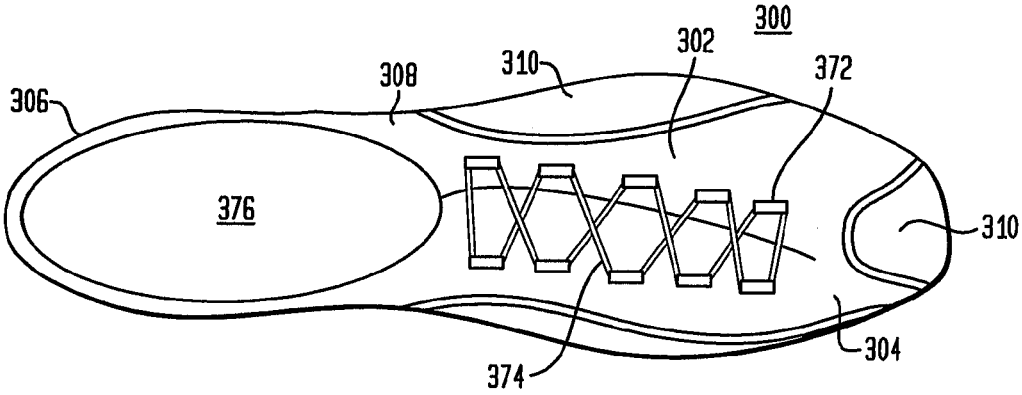
FIG. 10B is a top view of the dance shoe of FIG. 8A.
Figure 10C:
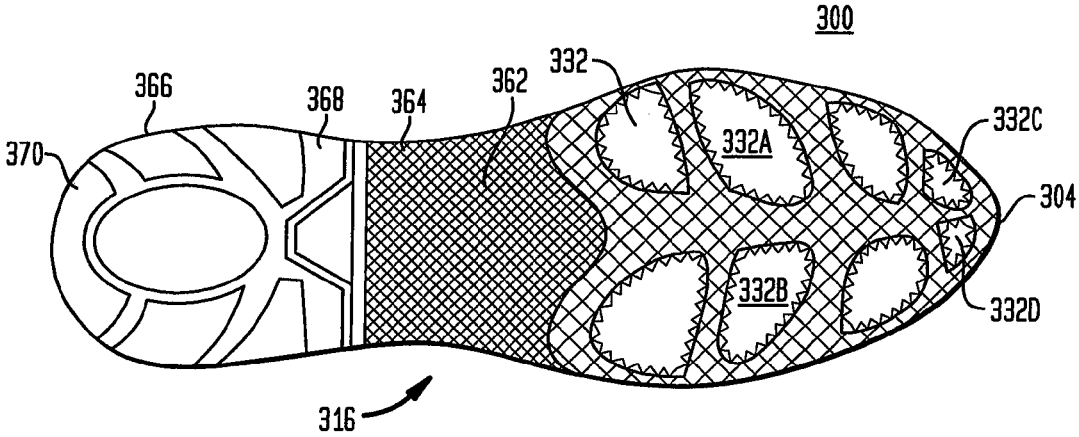
FIG. 10C is a bottom view of the dance shoe of FIG. 10A.

Referring to FIGS. 10A-10C, in accordance with another preferred embodiment of the present invention, a dance shoe 300 includes a shoe upper 302 and a toe region 304, a heel region 306 and a mid-section 308. The shoe upper 302 includes a reinforcement patch 310. The toe region 304 and lateral sides of the shoe upper in ball region of the shoe. The shoe upper may be made of any of the flexible fabrics disclosed previously herein.

Dance shoe 300 preferably includes a sole including first sole region 320 and second sole region 322 spaced therefrom. The underside of the dance shoe 300 in the first sole region is preferably covered with elastic or stretchable fabric such as a mesh fabric 362 having pores 364. The mesh fabric preferably extends between the arch 316 and the toe 304 of the shoe 300. In other preferred embodiments, the elastic fabric in the toe region of the shoe may be different than the elastic fabric in the arch region of the shoe. For example, the elastic fabric in the toe region may have more elasticity than the elastic material in the arch region.

The dance shoe 300 includes one or more protective pads 332 that are attached to the mesh fabric 362. In certain preferred embodiments, the pads 332 are attached to the exterior surface of the mesh fabric. The protective pads are preferably provided in the area of the mesh fabric that extends between the leading end of the arch and the toe 304. The protective pads 332 are preferably positioned to protect certain portions of the toes and ball of the feet. In one particular preferred embodiment, protective pads 332A and 332B protect the ball portion of a foot while protective pads 332C and 332D protect the toes of a foot. The elastic fabric extends between the opposing edges of the pads so that the ball section of the sole may expand and stretch in response to forces. In certain preferred embodiments, one or more of the pads may have one or more first regions that generates less traction with a floor surface and one or more second regions that generate more traction with a floor surface.

Referring to FIGS. 10A and 10C, the second sole region 332 of the foot may be covered by a more traditional sole 366 made of one or more of the materials described above. The sole 366 has a leading end 368 adjacent arch 316 and a trailing end 370 that defines a heel of dance shoe 300.

Referring to FIG. 10B, the shoe upper 302 may include one or more loops 372 adapted to receive a shoe lace 374 for tightening the dance shoe 300 about a foot and ankle of a user. In other preferred embodiments, one or more elastic elements may be provided around the shoe opening 376 for securing the shoe to a foot.

As noted above, the elastic or stretchable fabric preferably provides a dancer with sufficient tactile feel through the pores 364. The size of the pores 364 may be varied to maximize tactile feel while providing support on the underside of the dance shoe 300. The fabric 362 is preferably flexible and/or stretchable and/or elastic for enhancing freedom of movement of the dance shoe through various foot positions.

In certain preferred embodiments, the present invention may be combined with one or more of the embodiments disclosed in commonly assigned U.S. Pat. No. 7,337,558 entitled "Split Sole Dance Shoe Having Enhanced Flexibility And Support" which claims the benefit of U.S. Provisional Application Ser. No. 60/657,467 filed Mar. 1, 2005, the disclosures of which are hereby incorporated by reference herein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised and employed without departing from the spirit and scope of the present invention as defined by the appended claims.

What is claimed is:

1. A protective sleeve for a forward portion of a foot comprising:

a sleeve formed of elastic fabric, said sleeve having a leading end containing at least one toe opening arranged in a region where the toes are connected with the foot and a trailing end containing a foot opening arranged in a mid-region of the foot;

first and second protective pads attached to said sleeve adjacent to said foot opening, said pads being arranged laterally relative to an axis of said sleeve to cover at least a portion of a ball of the foot;

at least one strip of material extending between opposing edges of said first and second protective pads;

said elastic fabric of said sleeve extending at least partially between said first and second protective pads, wherein said elastic fabric is adapted to stretch between said first and second protective pads so that said pads continue to cover the ball of the foot during movement of the foot.

2. A foot covering as defined in claim 1, wherein said material strip comprises fabric or leather and has a first end attached to said first protective pad and a second end attached to said second protective pad.

3. A foot covering as defined in claim 1, wherein at least one of said protective pads has a first region and a second region having a tackier surface than the first region.

4. A foot covering as defined in claim 3, wherein said first region comprises a material selected from the group consisting of leather and suede and said second region comprises rubber.

5. A foot covering as defined in claim 1, wherein said elastic fabric comprises a material selected from the group consisting of lycra, lycra mesh, cotton, cotton lycra mesh, paper lycra, leather, leather with lycra, nylon, nylon mesh, and neoprene.

6. A foot covering as defined in claim 1, and further comprising an elastic band attached to the trailing end of said elastic fabric for holding said foot covering on a foot.

7. A dance shoe comprising:

a shoe upper;

a sole attached to said shoe upper, said sole including a ball region extending between an arch of said dance shoe and a toe of said dance shoe, said ball region adapted to cover a ball of a foot;

said ball region of said sole comprising an elastic fabric and first and second protective pads attached to said elastic fabric, said pads being arranged laterally relative to an axis of said sole;

said elastic fabric extends at least partially between said first and second protective pads, wherein said elastic fabric is adapted to stretch between said first and second protective pads so that said pads continue to cover the ball of the foot during movement of the foot.

8. A dance shoe as defined in claim 7, and further comprising a third protective pad attached to said elastic fabric and adapted to cover a toe of said foot.

9. A dance shoe as defined in claim 8, and further comprising a fourth protective pad attached to said elastic fabric and adapted to cover a second toe of said foot.

10. A dance shoe as defined in claim 7, and further comprising at least one strip of material extending between said first and second protective pads.

11. A dance shoe as defined in claim 7, wherein at least one of said protective pads has a first region and a second region having a tackier surface than said first region.

12. A dance shoe as defined in claim 11, wherein said first region comprises a material selected from the group consisting of leather and suede and said second region comprises rubber.

13. A dance shoe as defined in claim 11, wherein said elastic fabric comprises a material selected from the group consisting of lycra, lycra mesh, cotton, cotton lycra mesh, paper lycra, leather, leather with lycra, nylon, nylon mesh, and neoprene.

* * * * *